United States Patent [19]

Snellman et al.

[11] 3,963,235

[45] June 15, 1976

[54] ADJUSTABLE FEED LEVEL FOR SORTING DEVICE

[75] Inventors: Donald L. Snellman; Wade C. Vaughn, both of Seattle, Wash.

[73] Assignee: Norfin, Inc., Seattle, Wash.

[22] Filed: July 23, 1973

[21] Appl. No.: 381,983

Related U.S. Application Data

[63] Continuation-in-part of Ser. No. 297,357, Oct. 13, 1972.

[52] U.S. Cl. ..... 271/64; 198/117; 209/73; 271/197; 271/198

[51] Int. Cl.[2] ..... B65H 29/16

[58] Field of Search ..... 271/173, 197, 198, 200, 271/64; 198/117, 139, 165, 184, 118, 122, 176; 209/73

[56] References Cited

UNITED STATES PATENTS

| | | | |
|---|---|---|---|
| 1,686,519 | 10/1928 | Cutler | 198/184 |
| 1,766,142 | 6/1930 | Olson | 271/200 UX |
| 2,577,926 | 12/1951 | Stiles | 198/126 X |
| 2,631,715 | 3/1953 | Vickers | 198/118 |
| 3,321,202 | 5/1967 | Martin | 271/198 X |
| 3,358,831 | 12/1967 | Cothrell | 271/197 X |

*Primary Examiner*—Richard A. Schacher
*Attorney, Agent, or Firm*—Dowrey & Cross

[57] ABSTRACT

A vertically adjustable infeed conveyor section for the conveyor system of a sheet sorting device. The sheet sorting device is of the type having side-by-side vertical columns of bins with distributor means for directing individual sheets or groups of sheets of paper in series to the individual bins. The infeed conveyor section receives sheets of paper or the like from a sheet feeder, a duplicator, or printing press and delivers them to the conveyor system of the sorter. The infeed conveyor section is adjustable vertically to adapt itself to any height of sheet feeder or duplicator. The infeed conveyor section includes a horizontal initial section, an inclined transition section, and a delivery section having a vertical run to which the transition section extends. In a second preferred embodiment, the transition section extends directly to the upper terminous of the delivery section vertical run.

27 Claims, 8 Drawing Figures

ADJUSTABLE FEED LEVEL FOR SORTING DEVICE

BACKGROUND OF THE INVENTION

This application is a continuation-in-part of our original application entitled ADJUSTABLE FEED LEVEL FOR SORTING DEVICE, Ser. No. 297,357, filed Oct. 13, 1972.

The present invention relates in general to conveyor systems for sheet sorting devices which are designed to receive sheets of paper or the like, seriatim, from either a sheet feeding device or a duplicator, printing press or other such device and to distribute the sheets, one each, in a vertical column or stack of shelves. These shelves, or bins as they are normally called, will receive one each of a series of pages composing a document which is then removed and bound. As used in this specification, the term "sorting device" or "sheet sorter" will be understood to include both a distributor or conveyor system and a receiver component made up of vertically arranged bins or shelves. The present invention involves more particularly a vertically adjustable infeed section for the conveyor system of such a sorting device.

Conveyor systems for sorting devices of the character under consideration normally include some form of belt or tape, either single or multiple, for carrying the individual sheets or signatures from a receiving point to the individual shelves into which they are distributed. The conveyor system must, of necessity, have some means of holding the sheets to the moving conveyor tapes or belts. Devices such as vacuum plenums and positive hold-down members, in the nature of rollers and the like, have been used for these purposes in the past. The in-feed section of the conveyor system normally receives the sheets directly from a sheet feeder or duplicator at whatever level is required. This type of operation is known in the art as an "in line" operation and is peculiar to "sorters" as opposed to "collators" as these two types of machines are understood in the art. The in line method of sheet sorting is much more rapid than other forms which may require an extra step between printing and collating. Since sorters are themselves independent units which may be utilized with any number of available printers, duplicators or sheet feeders, the need has arisen for a convenient means for matching up a single sorter with any number of different level feeders or duplicators. This need has been especially felt in recent years when the sorters are mounted on casters or rollers and are used, more or less, as mobile units.

In the past, sorters have been equipped with fixed level in-feed conveyor sections, making it necessary to custom build a sorter to match specific brands or models of duplicators or feeders. The problems involved in successfully designing a vertically adjustable in-feed section are compounded by the fact that the conveyor tapes, or belts, as the case may be, are continuous. The in-feed section is normally integrated with the single conveyor system such that movement of any frame means or in-feed structure interferes with the normal running of the belts or conveyor tapes. Additionally, structural items, such as sheet hold-down means and the like, must be compatible with the relative movement between the in-feed section and the remaining parts of the conveyor system. The present invention seeks to provide an improved conveyor system which provides for positive vertical adjustment for the in-feed section without unduly complicating the conveyor itself and without interfering with normal conveyor operation.

Accordingly, the primary object of the present invention is to provide an in-feed conveyor section for a conveyor system of the character described which is vertically adjustable relative to the sorter device without interfering with normal conveyor operation.

Another object of the present invention is to provide an in-feed conveyor section of the character described which is an integral part of the conveying system.

Another object of the present invention is to provide an in-feed conveyor section of the character described which may be conveniently moved to any desired position of vertical adjustment and temporarily fixed in that position so as to receive incoming sheets from any level required.

Another object is to provide an in-feed conveyor section that moves the sheets through a path at less than ninety degree angles.

These and other objects and advantages of the invention will be apparent from the following specification and claims and from the accompanying drawings wherein:

DESCRIPTION OF THE PREFERRED EMBODIMENT

Figure 1:
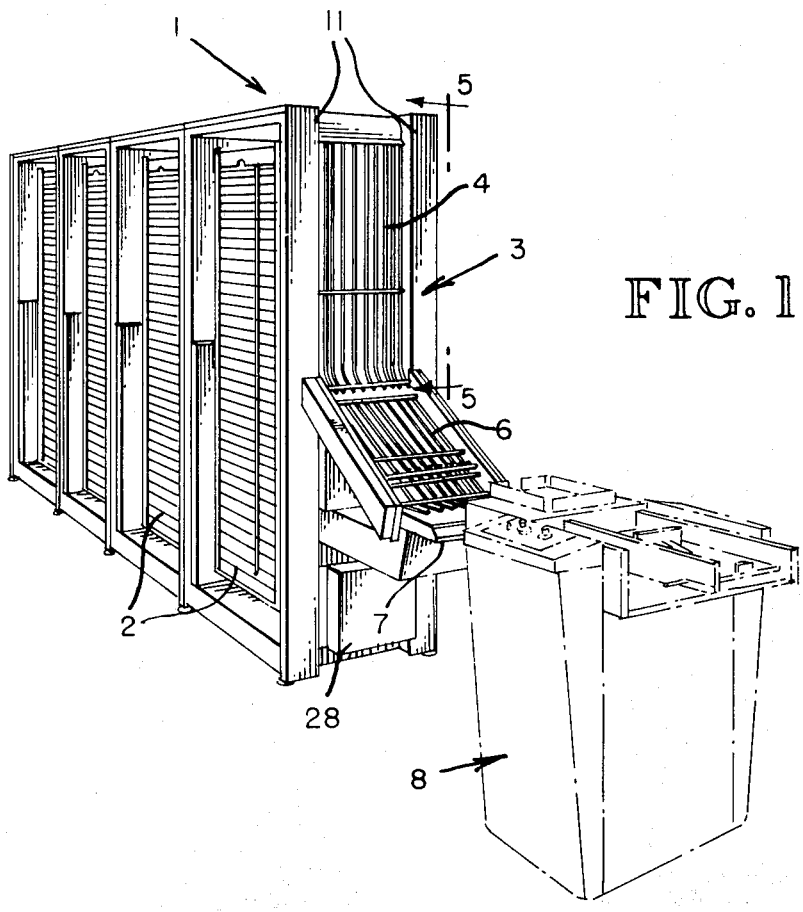
FIG. 1 is an overall perspective showing a sorting device with the adjustable feed level conveyor section of the present invention and the positioning of a typical sheet adjacent thereto.

Reference is made now to the drawings wherein like reference numerals are used to indicate identical parts in the various views. As seen in FIG. 1, the sheet sorter device, indicated generally at 1, includes the vertical tiers of receiver bins or shelves 2 and a distributor conveyor, the infeed section of which is indicated generally at 3. The infeed section of the conveyor includes a delivery section 4, a vertically adjustable inclined transition section 6, and a short horizontal initial section 7. A single endless conveyor belt runs through the transition and delivery section. The horizontal initial section 7 is adapted to receive sheets or signatures directly from a unit such as the sheet feeder indicated generally in phantom lines at 8. The sheet feeder is illustrated merely by way of example and is a standard device in the industry, and hence no attempt will be made to explain the structural details thereof.

Figures 4, 5, 5A:
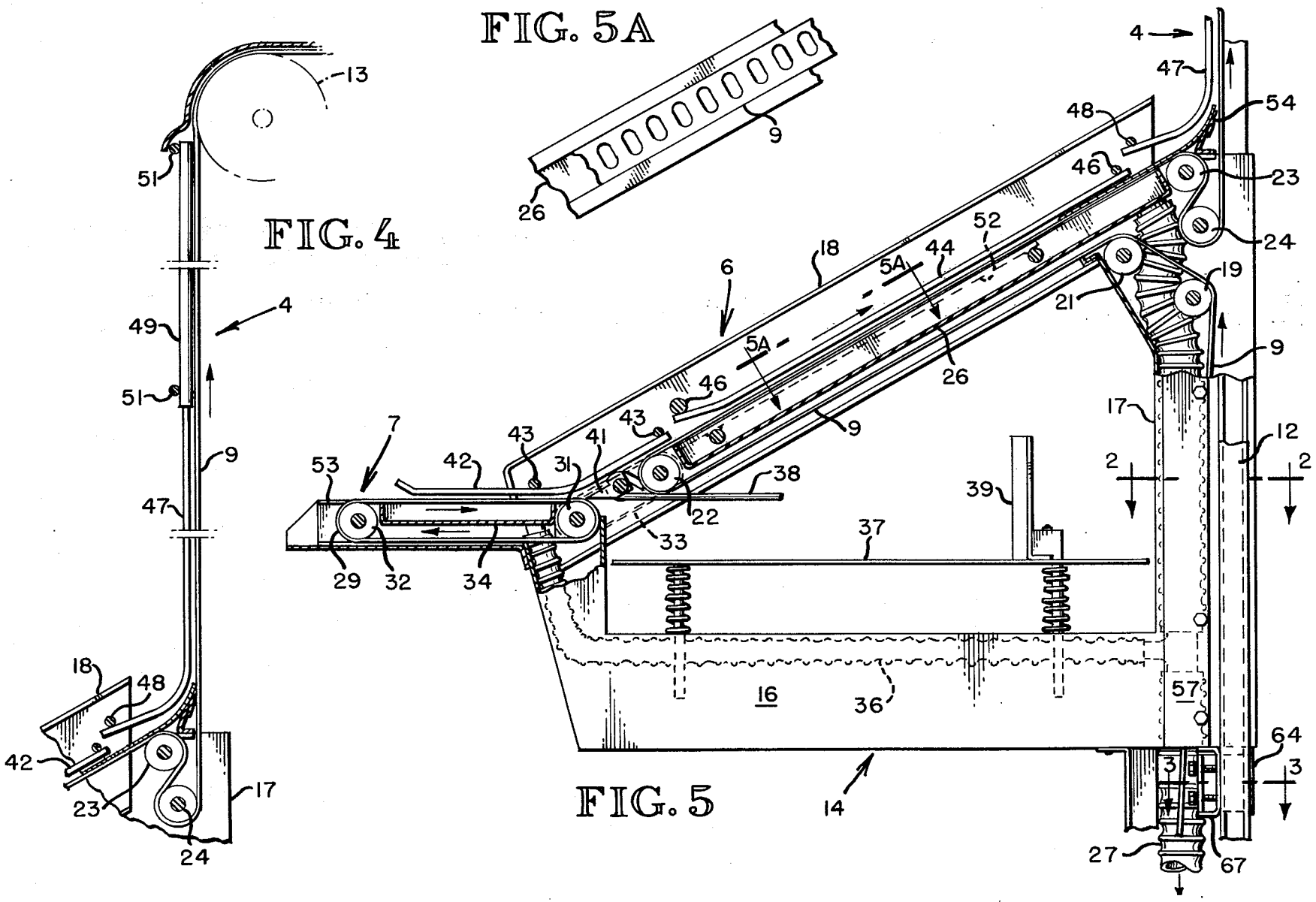
FIG. 4 is an elevational detail showing the upper portion of the infeed section of the conveyor systems.
FIG. 5 is a cross-sectional view taken along lines 5—5 of FIG. 1.
FIG. 5A is a detail view of the conveyor belt of the present invention.

As shown most clearly in FIGS. 4 and 5, the conveyor system of the present embodiment is illustrated as a single-belt vacuum system. The belt 9 moves upwardly along the path indicated and in the direction shown by arrows. The drive system for the conveyor belt forms no part of the present invention and may be located at any convenient spot. The sorter 1 is provided with vertical face panels 11, along which the adjustable transition section 6 travels, and a pair of laterally spaced vertical rails 12, upon which the transition section 6 is mounted and travels, as will be presently explained. The belt 9 is trained about an upper roller or idler drum 13, as shown in FIG. 4, and continues from that point to the vertical tiers of bins, as will be well understood by those skilled in the art. The lower end of the belt, beneath the vertically adjustable transition and initial sections 6 and 7, may be trained about a drive roller or the like (not shown) for driving the belt. A series of intermediate guide rollers are mounted on the moveable transition and initial sections 6 and 7 of the conveyor system as seen in FIG. 5.

The inclined vertically adjustable transition section 6 comprises a sheet metal housing, indicated generally at 14 in FIG. 5, which includes the lower horizontal panels 16 laterally spaced at the approximate position of the vertical rails 12. The housing 14 also includes vertical panels 17, which may be integral with the panels 16 and other portions of the sheet metal housing. It will be understood, of course, that the design details of the housing and the panels involved may be altered without departing from the spirit of the present invention. The panels 16 and 17 of the housing 14 form a right angular structure with the legs of the angle being connected by the inclined sheet metal panels 18 on either side of the structure. These parts or panels may be conveniently spot welded or bolted together to form the structure described, as will be understood by those skilled in the art.

As seen most clearly in FIGS. 4 and 5, the belt 9 travels in the direction of the arrows from bottom to top and about a series of guide rollers carried by the vertically adjustable transition section. The belt 9, in its upward course, passes first about the two rollers 19 and 21, which direct the belt in a downward direction along the inclined course and about the roller 22 at the lower end of the inclined portion. The belt is then directed upwardly for transporting sheets into the sorter as they are received from the horizontal initial section 7 of the infeed section. In order to make the transition from the generally inclined course to the vertical course, the belt 9 is passed about the two rollers 23 and 24, which give the belt a positive vertical direction.

As shown in FIG. 5A the conveyor belt 9 is provided with longitudinally spaced openings which cooperate with a vacuum plenum, over which the belt travels, for the purpose of maintaining sheets against the moving belt. The vacuum plenum for the inclined course of the transition section is located at 26 with the flexible vacuum conduit 27 providing vacuum pressure. As seen in FIG. 1, the conduit 27 may be housed in the container or bin 28 with enough slack to allow the movable portion to be adjusted vertically. The vacuum system, of course, will be provided with the necessary power driven vacuum pump (not shown) for maintaining the desired vacuum in the plenum.

The short horizontal initial section 7 is provided with its own conveyor belt 29 trained about the two rollers or pulleys 31 and 32. The drive for the belt 29 may be obtained by a chain or belt drive 33 trained about suitable pulleys or sprockets (not shown) on the axle shafts of the rollers 22 and 31, as shown in FIG. 5. The horizontal initial section 7 may also be provided with a vacuum plenum 34 and a vacuum conduit 36, which may be connected into the conduit 27 for convenience, as also shown in FIG. 5.

As is common with sheet sorters of the type under consideration, a proof tray 37 is mounted on the frame structure beneath the moving conveyor belt and is adapted to receive sheets which are deflected from the conveyor system. The deflection of sheets may either be on a selective basis by an operator, or automatically upon the completion of a collating cycle. The proof tray 37 will normally be spring mounted, as illustrated in FIG. 5, and a series of deflectors or guide rods 38 may be located above the proof tray in order to confine the sheets to the tray. The upright member 39 acts as a backstop for the sheets which are deflected into the tray. The sheets are deflected from the moving conveyor belts by means of the gate 41 which, when operated, acts to direct a sheet issuing from the horizontal belt 29 to the proof tray and prevents the sheet from moving on to the inclined run of the belt 9. The details of operation of the deflector gate have been omitted for simplicity's sake since they form no part of the present invention and are a well known feature in prior art devices of this type.

In addition to the vacuum belt, a positive hold-down means is provided in the nature of the laterally spaced rods 42 which are spot welded or otherwise secured to the transverse rods 43. The hold-down rods 42 extend over the major portion of the horizontal initial section 7 and the lower end of the inclined transition section 6 of the conveyor. A second set of hold-down rods 44 is provided for the major portion of the inclined run of the belt and may be secured to the transverse rods 46. A third set of hold-down rods 47 is provided, with the rods being connected at their lower ends to the cross rod 48. The rods 47 extend vertically, parallel to the vertical run of the conveyor belt 9, and are telescoped into a series of tubes 49 which are fixed to the transverse rods 51 extending between the face panels 11 of the sorter. Thus it may be seen that, as the infeed section reciprocates vertically, the hold-down rods 47 telescope within the tubes 49. To complete the conveyor system, the inclined transition section 6 is provided with a stationary backup plate or pan 52 for supporting the paper or sheets and the horizontal initial section 7 is provided with the backup plate 53 for the same purpose. As the sheets travel from the inclined run of the conveyor belt to the vertical run, a smooth transition is obtained by means of the arcuate plate 54 which extends between the vertical panels 17.

Figure 2:
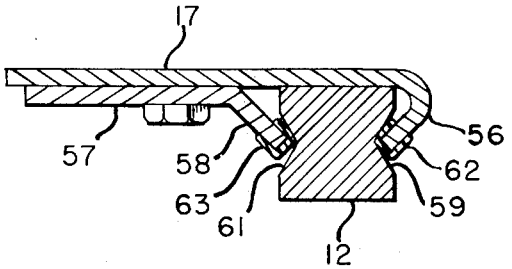
FIG. 2 is a cross-sectional detail taken along line 2—2 of FIG. 5.
Figure 3:
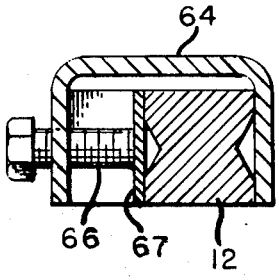
FIG. 3 is a cross-sectional detail taken along lines 3—3 of FIG. 5.

Referring now more particularly to FIGS. 2 and 3, each vertical side panel 17 is provided with a reversely bent lip or flange 56 along its vertical edge which cooperates with the adjacent vertical rail carried by the sorter frame. The panels 17 are also provided with sheet metal face plates 57, bolted or otherwise secured thereto. The plates 57 are provided with angled edges or flanges 58 which cooperate with the vertical rails 12 in the same manner as the flanges 56. The rails are equipped with longitudinally extending grooves 59 and 61 for engaging the edges of the flanges 56 and 58, respectively. In order to minimize friction between the flanges and the grooves while raising and lowering the infeed conveyor section, the edges of the flanges may be provided with neoprene coverings or the like 62 and 63, respectively, which extend the length of the flanges.

With this arrangement, the entire infeed conveyor section may be adjusted vertically in order to match any particular sheet feeder or duplicator. The conveyor section is held in its vertically adjusted position by means of the clamp illustrated in FIGS. 3 and 5. The clamp constitutes a U-shaped member 64 which is provided with the set screws 66 for applying a holding pressure against the contact plate 67 and the vertical rail 12. It will be understood that identical clamping members may be used for each of the vertical rails 12 and may be manually set to lock the adjustable infeed section in the particular position chosen.

Figure 6:
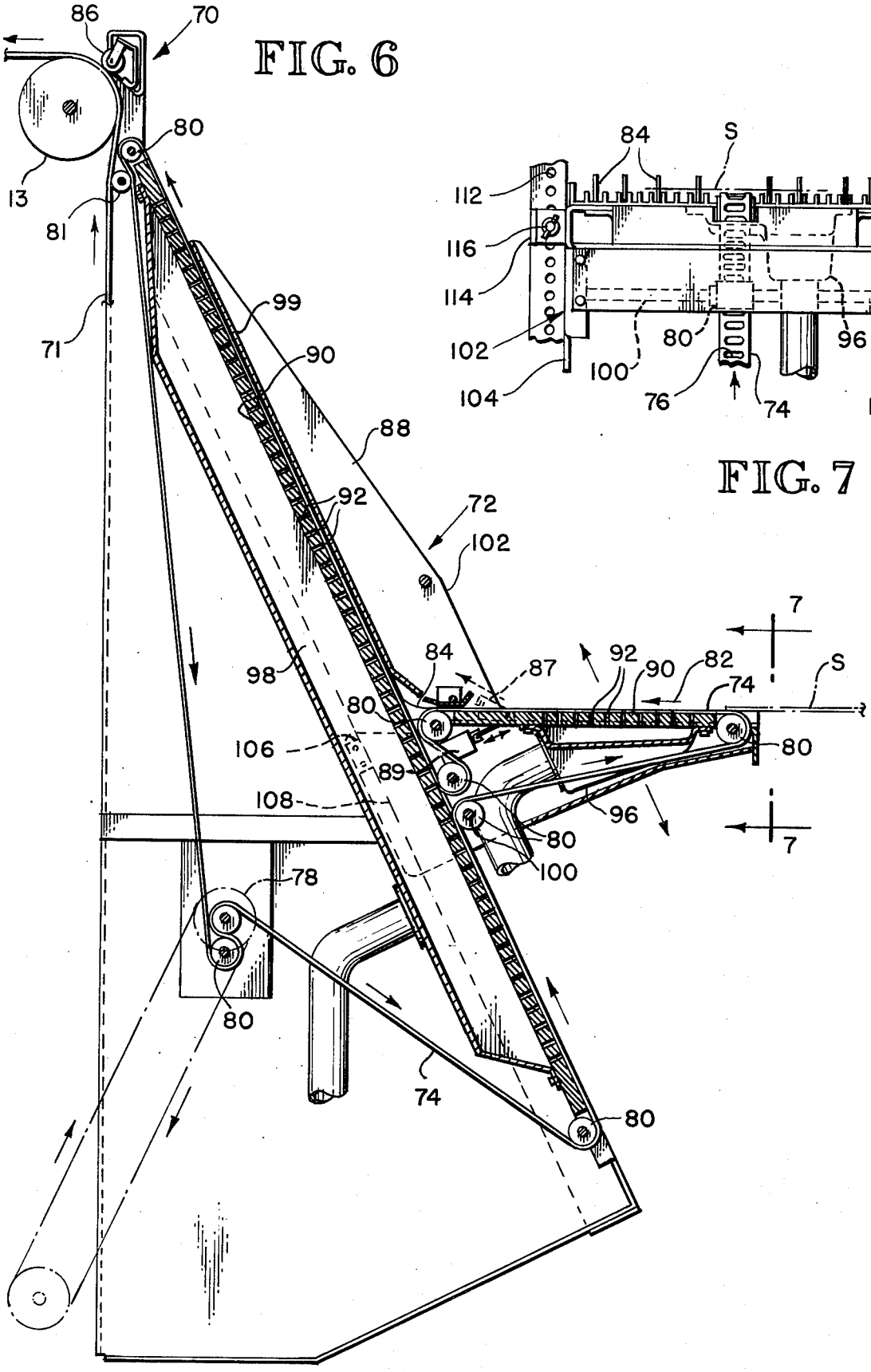
FIG. 6 is a vertical section of a second embodiment of in-feed conveyor section.
Figure 7:
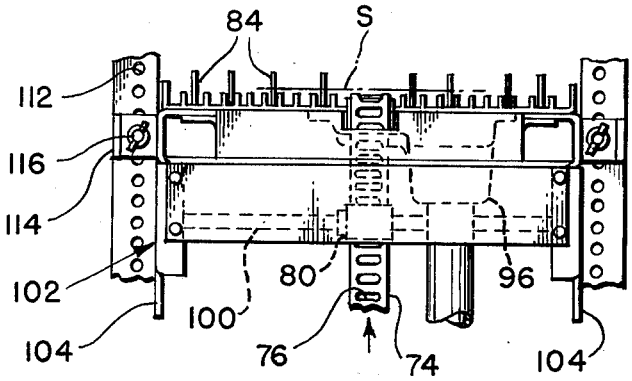
FIG. 7 is an end elevation looking along the line 7—7 of FIG. 6.

The embodiment of the invention illustrated in FIGS. 6 and 7 is an improved and preferred form of the invention. In this embodiment, the sorter 70 is provided with its own conveyor belt 71 which runs up around the conveyor roller 13 as previously described. The infeed conveyor section 72 comprises a horizontal initial section and an inclined transition section extending between the initial section and the upper terminous of the delivery section vertical run and is provided with an independent conveyor belt 74, provided as is belt 71 and earlier described belt 9, with openings 76. The belt 74 is entrained around a drive roller, driven by a sprocket 78, and a plurality of idler rollers 80 which guide the belt along a continuous path. A small idler roller 81 separates the belts 71 and 74 and allows the uppermost idler roller 80 to be placed closely adjacent the roller 13 so as to reduce the gap between the belt 74 and the belt 71. Sheets of paper S are delivered at the righthand end of the in-feed conveyor and moved in the direction of the arrow 82. The sheets are then carried by the belt 74 over diversion plates 84 which divert the sheets onto the inclined run of the belt, upwardly past the upper idler roller 80, and between a small pinch roller 86 and the belt 71 to carry the sheets into the sorting machine. A small diverter section 87 is pivotally mounted on either side of the belt 74 and when energized moves upwardly to the phantom line position diverting the incoming sheet into a proof tray 88. The diverter is controlled by a solenoid 89.

As earlier described, the belt 74 runs over a plenum chamber 90 having openings 92 which open to vacuum chambers 96 and 98. Vacuum provided in the chambers draws the papers against the surface of the belt 74 to hold it tightly against the belt as it is being rapidly conveyed. A holddown plate 99 assures that the paper is held against the belt as it is carried up the inclined surface of the in-feed conveyor.

In order to shift the initial or horizontal section of the in-feed conveyor upwardly along the inclined or transition section, that is, in a direction toward the delivery section of the conveyor system, the three clustered idler rollers 80 at the intersection of the initial and transition sections are journaled for rotation on shafts 100 which are held in a framework 102. The framework 102 supports the vacuum chamber 96 and the horizontal run of the endless belt 74 and is movable along the inclined run of the belt. The framework 102 is provided with a pair of side plates 104 which have blocks 106 that ride in guideways 108 in the transition section. The blocks 106 can be held by friction at any desired location along the guideways 108 or, if desired, can be pinned or clamped in the guideways by any conventional means. One typical example is illustrated in FIG. 7 in which the transition section is provided with indexing openings 112 on either lateral side thereof. Brackets 114 are provided on the framework 102. A plurality of spring biased pins 116 are mounted on the brackets 114. As is well understood, the pins can be withdrawn and the initial section slid along the transition section to the desired location. At that location, the pins 116 are then released into the appropriate index openings 112.

As is readily apparent, the embodiment of the invention illustrated in FIGS. 6 and 7 provides the advantage of reducing the angle between the inclined surface of the transition section and the delivery section horizontal run above the roller 13. This enables sheets to be transferred between the transition section and the delivery section at a greater speed and with less jamming. Another advantage is that the belt 74 is completely independent of the belt 71 thus allowing the infeed conveyor section to be fabricated and stocked in inventory as a modular component that can be added to a large variety of standard sorters.

With the structure described, it will be apparent to those skilled in the art that the present invention provides a novel arrangement for adjusting the infeed conveyor section of a sheet sorter without interfering with the normal operation of the conveyor system. The structure described provides a simple and compact arrangement for accomplishing the adjustment of the infeed section, thereby enhancing the utility of the sorter which can then be adapted for use with any known sheet feeder or duplicating apparatus.

It is believed that the invention will have been clearly understood from the foregoing detailed description of the preferred embodiment. Changes in the details of construction may be resorted to without departing from the spirit of the invention and it is accordingly intended that no limitation be implied and that the hereto annexed claims be given the broadest interpretation to which the employed language fairly admits.

The embodiments of the invention in which a particular property or privilege is claimed are defined as follows:

1. In combination with a sheet sorting device; a sheet conveyor system for receiving and transporting sheets to receiver bins, said conveyor system including conveyor belt means having a generally vertical run, an infeed section associated with said vertical run, and having guide means for first directing said belt means away from the direction of said vertical run along a lower run and then in a reverse direction along an upper run to return to said vertical run, said upper run being adapted to receive incoming sheets to the conveyor system, and means mounting said infeed section for vertical reciprocating adjustment along the vertical run of the belt means.

2. The combination according to claim 1 wherein said upper run is directed in an upwardly inclined direction to return to the generally vertical run.

3. The combination according to claim 2 wherein said sorting device includes laterally spaced vertical guide members on each side of the vertical run of said belt and the mounting means for said infeed section includes supporting slide members in engagement with each said guide members for vertical movement of the infeed section therealong and releasable stop means mounted on the guide rods to support the section at a selected position of vertical adjustment.

4. The combination according to claim 3 wherein each of said supporting slide members comprises first and second elongated flanges, each of said guide v members having first and second grooves therein, said flanges being engaged in said grooves, and anti-friction means located between each flange and the associated groove.

5. The combination according to claim 4 including a first set of sheet hold-down members mounted on the infeed section and overlying the upwardly inclined run of said conveyor belt, and a second set of vertically disposed telescoping sheet hold-down members, the bottom ends of said second hold-down members being connected to said infeed section and the telescoping under ends thereof being fixed to the sorting device adjacent the upper portion of the vertical run of said conveyor belt.

6. The combination according to claim 1 wherein said belt means comprises an endless belt running from said guide means through the vertical run.

7. The combination of claim 6 further comprising a second endless belt, and second guide means for directing said second belt along a substantially horizontal run terminating adjacent the reversely directed portion of the first-mentioned belt, and wherein the reversely directed portion of the first-mentioned belt is directed in an upwardly inclined direction to return to said vertical run.

8. The combination of claim 1 wherein said belt means comprises a first endless belt running away from the direction of said vertical run and then in a reverse direction to return to said vertical run, and a second endless belt running from the location at which said first belt returns to said vertical run through the remainder of the vertical run.

9. The combination of claim 8 wherein the reversely directed portion of said first belt is directed in an upwardly inclined direction to return to the vertical run, and further comprising second guide means for directing a portion of the reversely directed portion of said belt along a substantially horizontal run.

10. In combination, a sheet sorting device having a sheet conveyor system including a delivery section for receiving and transporting sheets to individual bins, an initial section for receiving these sheets along a generally horizontal path, a transition section for receiving the sheets from said horizontal path and carrying the received sheets to said delivery section along an upwardly inclined path, and means for adjustably securing the position of said initial section along said transition section for varying the location along said inclined path at which sheets are received from said initial section such that the height of said horizontal path is adjustable to receive sheets at different heights.

11. The combination of claim 10 said conveyor system including a first belt movable through said delivery section and a second belt movable through said transition and initial sections.

12. The combination of claim 10 said conveyor system including a first endless belt movable through said delivery section and a second endless belt movable through said transition and initial sections, and means for maintaining the length of said second endless belt regardless of the position of said initial section relative to said transition section.

13. A sheet conveyor adapted for use with a sheet sorting device, comprising: an endless belt, first guide means for directing said belt along an upwardly inclined run, second guide means for first directing said belt along a lower run away from the direction of said inclined run and then along an upper run in a reverse direction to return to said inclined run, said second guide means being adjustably positionable to vary the vertical location at which said upper run returns to said inclined run.

14. The sheet conveyor of claim 13 including an inclined generally flat wall along which said inclined run extends, said second guide means being detachably secured with said wall.

15. The sheet conveyor of claim 14 wherein said wall includes a plurality of openings, and further including means defining a plenum communicating with said openings, said belt including a plurality of openings.

16. The sheet conveyor of claim 14 wherein said wall includes a series of openings extending in two mutually parallel lines respectively adjacent the sides of the inclined run, and wherein said second guide means includes coupling means selectively engageable with said openings.

17. The sheet conveyor of claim 13 wherein the reversely directed portion of said belt is substantially horizontal.

18. The sheet conveyor of claim 17 wherein said second guide means includes a generally flat wall along which the reversely directed portion of said belt extends, said wall including a plurality of openings, and further including means defining a plenum in communication with said openings, said belt including a plurality of openings.

19. In combination with a sheet sorting device including laterally spaced vertical guide members; a sheet conveyor system for receiving and transporting sheets to receiver bins, said conveyor system including conveyor belt means having a generally vertical run extending between said guide members, an infeed section associated with said vertical run, and having guide means for first directing said belt means away from the direction of said vertical run and then in an upwardly inclined reverse direction to return to said vertical run, the reversely directed portion of the belt means being adapted to receive incoming sheets to the conveyor system, and means mounting said infeed section for vertical reciprocating adjustment along the vertical run of the belt means, said mounting means including supporting slide members in engagement with each said guide members for vertical movement of the infeed section therealong, and releaseable stop means mounted on said guide members to support the infeed section at a selected position of vertical adjustment.

20. The combination according to claim 19 wherein each of said supporting slide members comprises first and second elongated flanges, each of said guide members having first and second grooves therein, said flanges being engaged in said grooves, and anti-friction means located between each flange and the associated groove.

21. The combination according to claim 20 including a first set of sheet hold-down members mounted on the infeed section and overlying the upwardly inclined run of said conveyor belt means, and a second set of vertically disposed telescoping sheet hold-down members, the bottom ends of said second hold-down members being connected to said infeed section and the telescoping upper ends thereof being fixed to the sorting device adjacent the upper portion of the vertical run of said conveyor belt means.

22. In combination with a sheet sorting device; a sheet conveyor system for receiving and transporting sheets to receiver bins, said conveyor system including conveyor belt means having a generally vertical run and including first and second endless belts, an infeed section including first and second guide means associated with said vertical run, said first guide means directing said first belt away from the direction of said vertical run and then in a reverse direction to return to said vertical run, said first belt running from said first guide means through the vertical run, and second guide means for directing said second belt along a substantially horizontal run terminating adjacent the reversely directed portion of said first belt, the reversely directed portion of said first belt being directed in an upwardly inclined direction and adapted to receive incoming sheets to the conveyor system, and means mounting said infeed section for vertical reciprocating adjustment along the vertical run of said belt means.

23. In combination with a sheet sorting device; a sheet conveyor system for receiving and transporting sheets to receiver bins, said conveyor system including conveyor belt means having a generally vertical run, and including first and second endless belts, and infeed section associated with said vertical run, and having guide means for first directing said first belt away from the direction of said vertical run and then in a reverse direction to return to said vertical run, the reversely directed portion of said first belt being adapted to receive incoming sheets to the conveyor system, said second belt running from the location at which said first belt returns to said vertical run through the remainder of said vertical run, and means mounting said infeed section for vertical reciprocating adjustment along the vertical run of said belt means.

24. The combination of claim 23 wherein the reversely directed portion of said first belt is directed in an upwardly inclined direction to return to the vertical run, and further comprising second guide means for directing a portion of the reversely directed portion of said first belt along a substantially horizontal run.

25. A sheet conveyor adapted for use with a sheet sorting device, comprising: an endless belt including a plurality of openings, an inclined generally flat wall including a plurality of openings, means defining a plenum communicating with said wall openings, first guide means for directing said belt along said wall in an inclined run, second guide means for first directing said belt away from the direction of said inclined run and then in a reverse direction to return to said inclined run, said second guide means being detachably secured with said wall to vary the location at which the reversely directed portion of said belt returns to said inclined run.

26. A sheet conveyor adapted for use with a sheet sorting device, comprising: an endless belt, a generally flat wall including a series of openings extending in two mutually parallel lines, first guide means for directing said belt along said wall in an inclined run in which the sides of the run are respectively adjacent the two lines of openings, second guide means for first directing said belt away from the direction of said inclined run and then in a reverse direction to return to said inclined run, said second guide means including coupling means selectively engageable with said openings to vary the location at which the reversely directed portion of said belt returns to said inclined run.

27. A sheet conveyor adapted for use with a sheet sorting device, comprising: an endless belt including a plurality of openings, a generally flat wall including a plurality of openings, means defining a plenum communicating with said wall openings, first guide means for directing said belt along an inclined run, second guide means for first directing said belt away from the direction of said inclined run and then in a substantially horizontal reverse direction along said wall to return to said inclined run, said second guide means being adjustably positionable to vary the vertical location at which the reversely directed portion of said belt returns to said inclined run.

* * * * *